United States Patent [19]

Crum et al.

[11] 4,008,664

[45] Feb. 22, 1977

[54] INK KEY CONTROL SYSTEM

[75] Inventors: James N. Crum, Stonington; Ernest H. Treff, Groton, both of Conn.

[73] Assignee: Harris-Intertype Corporation, Cleveland, Ohio

[22] Filed: Mar. 24, 1975

[21] Appl. No.: 561,418

Related U.S. Application Data

[63] Continuation of Ser. No. 381,908, July 23, 1973, abandoned.

[52] U.S. Cl. ..... 101/365; 101/350; 101/207; 250/226; 324/140 R

[51] Int. Cl.[2] ..... B41F 31/04

[58] Field of Search ..... 101/178–183, 101/148, 206–208, 349–352, 364–367, 426; 324/121, 140, 156; 250/226

[56] References Cited

UNITED STATES PATENTS

| | | | |
|---|---|---|---|
| 2,902,927 | 9/1959 | Ross | 101/365 |
| 2,968,988 | 1/1961 | Crosfield | 101/202 |
| 2,969,016 | 1/1961 | Crosfield et al. | 101/202 |
| 3,376,426 | 4/1968 | Frommer et al. | 250/226 |
| 3,474,438 | 10/1969 | Lanher | 324/121 R |
| 3,487,308 | 12/1969 | Johnson | 324/121 R |
| 3,623,430 | 11/1971 | Lessnn | 101/365 |
| 3,741,118 | 6/1973 | Carley | 101/426 |
| 3,792,659 | 2/1974 | Albrecht | 101/365 |

*Primary Examiner*—Edgar S. Burr
*Assistant Examiner*—William Pieprz

[57] ABSTRACT

In a printing press, a remote control apparatus for adjusting ink keys to control ink film thickness at various lateral portions of the ink fountain has an inspection table for supporting paper printed with an image by the press and a plurality of switches mounted at the leading edge of the paper on the table. Each switch is aligned with a respective portion of the printed image corresponding to a respective ink key wich can be adjusted by the switch. A display such as a cathode ray tube simultaneously displaying the settings of all of the ink keys is combined with the inspection table and switch arrangement, with the setting of each ink key being displayed in a different horizontal location, arranged in the same horizontal order as the switches that control them. A respective portion of the display image is vertically deflected for each respective key position, with increasing deflection corresponding to increasing ink film thickness, to create an image of the shape of the ink film distribution. Each of the switches is operable from a neutral position to far and near positions to adjust the respective ink key and consequently change the deflection of the respective portion of the display image. The geometrical relationship of image, keys, switches, and display provides great operating convenience.

2 Claims, 3 Drawing Figures

INK KEY CONTROL SYSTEM

This is a continuation of application Ser. No. 391,908, filed July 23, 1973, now abandoned.

The present invention relates presses printing pressures having ink fountains from which ink is delivered in a controlled manner for printing of images on paper or other stock. In particular, the invention relates to control and display apparatus for adjusting the thickness of ink film at various lateral locations of an ink fountain by remote control from an operating station.

The operating station includes an inspection table, a group of switches for adjusting respective ink film control keys of the various lateral locations of the ink fountain, and a display device which may be a cathode ray tube (CRT) for displaying the settings of the ink keys. The inspection table is provided for supporting a piece of recently printed paper or other stock for convenient inspection from an operator's position at the station. The switches are arranged so as to be at the leading edge of the printed paper, each switch being in line with a respective longitudinal rectangular portion or column of the paper whose ink supply is established by a respective ink key that can be adjusted by the particular switch.

The display device displays simultaneously the settings of all of the ink keys side-by-side, in a horizontal array, with the displays for the keys being arranged in the same order horizontally as the respective switches which control the ink keys. The setting of each ink key is indicated by the CRT beam, if the display is a CRT, whose vertical deflection, measured with respect to a fixed horizontal base line, is proportional to the setting of the ink key. Thus, beam deflections for all of the keys are upward or downward from a common base line. When an ink key is adjusted by operating one of the switches, the vertical deflection of the beam changes upward or downward in the direction which is expected and natural in view of the direction in which the switch was moved to effect the change.

The locations of the switches in line with a portion of the printed image whose ink density they control, and the arrangement of the display to depict the shape of the ink film distribution gap at the ink fountain and in scale model relation to the locations of the switches and the corresponding columnar portions of the printed image, provides a control apparatus of remarkable convenience and utility for adjusting the ink fountain. This is a result of a strong geometric correspondence among the four principal elements of the control situation namely: (a) the various columnar portions of the printed image, (b) the respective ink keys of the ink fountain, (c) the respective switches, which control the ink keys, and (d) the display, which shows the respective positions of the ink keys.

Accordingly, one object of the present invention is to provide, in a printing press, a remote control apparatus for adjusting ink film and including an inspection table for supporting printed stock and having a visual display located near the inspection table for simultaneously displaying the settings of all of the ink keys of the printing press, with greater ink film settings resulting in greater deflections, with the key displays being arranged in the same order on the display as the respective portions of the printed image at the inspection table, and having a manual switch means aligned at an edge of the printed stock in line with a portion of the printed image whose ink supply is controlled substantially by a respective ink key. A further aim of the first object is that each switch be operable for adjusting the respective ink key to different positions, in response to which a respective horizontal portion of the display image is deflected a greater or smaller amount.

Other objects and features of the invention will become apparent upon a consideration of the following description taken in conjunction with the accompanying drawings wherein.

Figure 1:
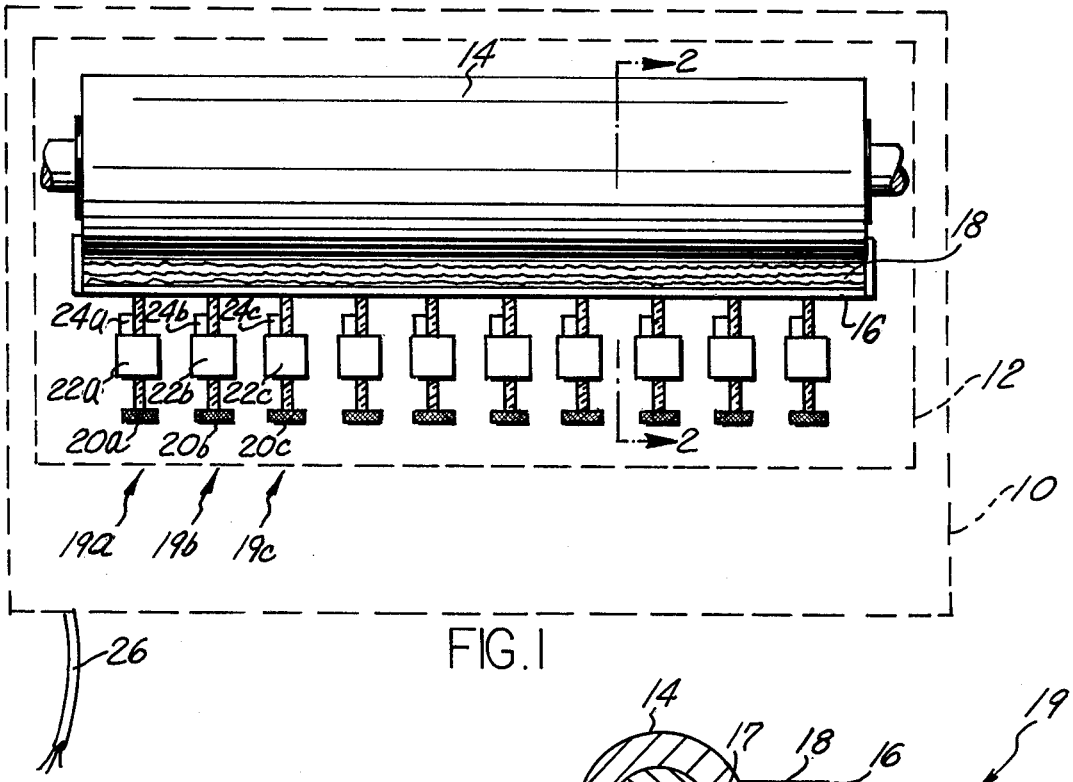
FIG. 1 shows a printing press and an ink fountain of the press, including ink film adjustment keys.

In a preferred embodiment of the invention, a printing press has an ink fountain that can be adjusted to control ink film differently at different lateral locations along the fountain for supplying ink for printing images on a web or on sheets of paper. The printing press is represented symbolically by a block 10 of FIG. 1 and includes an ink fountain 12 which has an inker roll 14 extending laterally across the width of the press. In close proximity to the inker roll 14 and extending laterally along it is a flexible doctor blade 16, either segmented or unitary, whose spacing from the inker roll 14 can be adjusted at various lateral locations along the roll 14 to control locally the amount of ink passing from the ink fountain 12 to printing cylinders (not shown) of the printing press 10.

Figure 2:
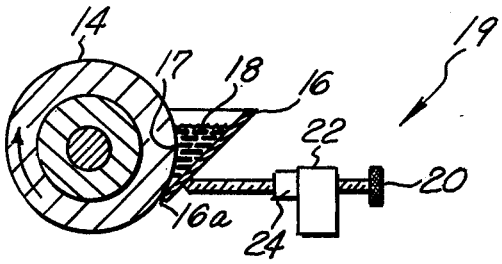
FIG. 2 is an end view of a portion of the ink fountain taken along a line 2—2 of FIG. 1.

As shown in FIG. 2, an angular portion 17 of the inker roll 14 forms one main wall of an ink reservoir whose other principal wall is the doctor blade 16, in an arrangement which is well-known in the prior printing art. Ink 18 passes from the ink reservoir through a space between the surface of the inker roll 14 and a lower edge **16*a* of the doctor blade 16, to establish a controlled thickness of ink on the inker roll 14**.

A plurality of ink flow adjustment devices 19, which are individually denominated **19*a*, 19*b*, etc. are deployed at various lateral locations along the ink fountain 12 to press against the flexible doctor blade 16 at those locations to establish and adjust the size of the ink film space between the inker roll 14 and the doctor blade 16 in each respective neighborhood. Preferably, each ink flow adjustment device 19 includes an ink key 20, individually called 20*a*, 20*b*, etc., having screw threads engaging threads in a fixed portion of the frame of the ink fountain, and whose tip pushes against the doctor blade 16 to deflect it and, thereby, provide locally adjustable control of the blade's spacing from the inker roll 14. Each key may be operated manually by turning a knurled head, or driven by a small bidirectional actuator motor 22. The motors are individually designated 22*a*, 22*b*, etc., and they move the keys 20 in and out axially. Also provided is a position sensing means for each of the keys 20, including a potentiometer 24, individually numbered 24*a*, 24*b*, etc. whose movable arm is mechanically connected with the key 20 so as to assume a position representative of the position of the key 20. Each potentiometer 24 is energized electrically at its outside terminals so that an electrical signal indicative of the position of the key 20** is produced at a potentiometer terminal that is connected to the movable arm.

Each motor 22 is electrically actuatable to drive its respective key 20 in either direction in accordance with electrical commands received on a conductor which is part of a cable 26, which interconnects the ink fountain 12 with an operating station to be described in more detail hereinafter. The output signals from the potentiometers 24, which may be multiplexed if desired, are connected to other conductors of the cable 26.

Figure 3:
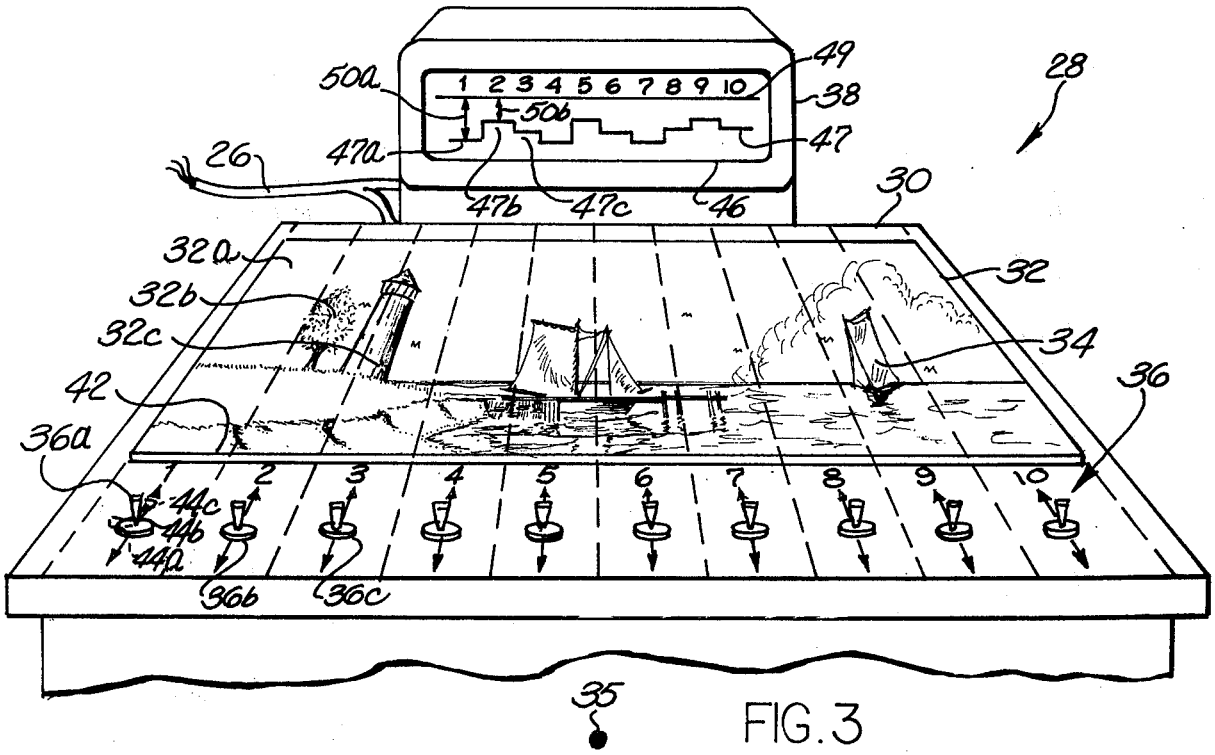
FIG. 3 is a pictorial view of an operating station having a table, manual switches for adjusting the ink flow adjustment keys of FIG. 1, and a cathode ray tube for displaying the settings of the keys.

The operating station, generally indicated by reference numeral 28 of FIG. 3, includes an inspection table, a group of switches for remotely controlling the ink key actuators, and a CRT display means for displaying the ink key settings. An inspection table 30 is provided for supporting a printed specimen 32 of the paper or other stock which bears an image 34 printed by the printing press 10. An operator can stand at a place 35 from which it is convenient to view simultaneously the printed sheet 32, an array of switches 36 for adjusting the ink keys 20, and a CRT display means 38.

Various longitudinal rectangular portions 32*a*, 32*b*, 32*c*, etc. of the printed sheet 32 carry portions of the complete image 34 whose individual ink density is each controlled principally by a respective one of the ink keys 20*a*, 20*b*, 20*c*, etc. The press operator can adjust the ink density in each of the columnar regions 32*a*, 32*b*, etc. mainly by means of the correspondingly aligned ink key 20*a*, 20*b*, 20*c*, etc., although some overlapping of ink flow exists among the columnar regions 32*a*, 32*b*, etc.

An array of manual control switches 36 is provided at the leading edge 42 of the printed sheet 32, with each individual switch 36*a*, 36*b*, 36*c*, etc. of the array being longitudinally aligned respectively with one of the columns 32*a*, 32*b*, etc, of the printed stock. Each of the switches 36 controls the position of a particular one of the ink keys 20 which establishes the ink density on the columnar portion 32*a*, 32*b*, etc. of the image with which the respective switch 36 is longitudinally aligned.

Each of the switches 36 is operable to three positions: a central neutral position 44*b*, a near position 44*a* in which the lever of the switch is closer to the operator's place 35, and a far position 44*c* in which the lever is farther from the operator's place 35. The near and far positions 44*a*, 44*c*, are spring return positions, from which the switch returns to the neutral position 44*b* when released by the operator. In the near position 44*a*, the switch actuates the key actuator motor 22 to move the respective key 20 to establish a greater space between the doctor blade 16 and the inker roll 14; in the far position 44*c*, the switch 36 actuates the bidirectional motor 22 to drive the respective ink adjustment key 20 in a direction to reduce the ink film space in a respective lateral neighborhood of the inker roll 14. Preferably, the motor 22 operates the key 20 at a constant rate and only so long as a switch 36 is manually held in one of its spring positions 44*a*, 44*c*. In this way the switches 36 are selectively operable to increase or decrease the ink density in a corresponding longitudinally aligned columnar region of the complete image 34.

Switch means of types other than the illustrative switch 36 can, of course, be employed. For example, two spring-return pushbutton switches corresponding to the positions 44*a* and 44*c* respectively, could instead be employed, or a unitary type of switch such as a rocker switch would be all right.

The CRT display means 38 that is provided at the inspection station simultaneously displays the positions of all of the ink keys as deflections of the CRT beam trace 47 from a common horizontal base line 49. In the illustrated embodiment deflections are downward. Downward is the direction in which more open flow spaces of the doctor blade would appear, if the operator were at the ink fountain itself. Of course, the deflections instead can be upward from a common baseline. Also, the CRT or other display face can be horizontal, in which case upward means away from the operator. The CRT display means 38 includes signal multiplexing and processing circuitry which receives the ink key position signals from the potentiometers 24 that were described above. Circuits for producing the display 38, some of which can be located at the printing press, are within the knowledge of those having ordinary skill in the electronic art. When a key is turned manually, the potentiometer deflects a corresponding portion of the CRT beam, so that the display is a correct representation whether the adjustment is made manually or by motor. The signal from each of the potentiometers 24 is displayed in a different horizontal location of the CRT screen 46 as a portion of the composite display. Preferably, a short horizontal line 47*a*, 47*b*, 47*c*, etc. is traced by the CRT beam for each ink key 20*a*, 20*b*, 20*c*, etc. The vertical distance between the trace line 47 and the base line 49 is a display portion whose size is vertically defined. The size is proportional to the spacing of the doctor blade 16 from the inker roll 14 of the ink fountain. Collectively, all of the short horizontal lines 47*a*, 47*b*, etc. pictorially describe the contour of the edge 16*a* of the doctor blade 16 with respect to the surface of the inker roll 14. The order of arrangement of the lines 47*a*, 47*b*, etc. representing the individual ink keys 20 on the CRT display is the same as the order of the switches 36 which control the respective ink keys, and is therefore the same as the order horizontally of the rectangular regions 32*a*, 32*b*, 32*c* of the image whose ink densities are controlled by the respective ink keys. For example, the distance 50*a* on the display, from the base line 49 to the short horizontal line 47*a*, represents the ink film space in a region of the doctor blade 16 located at the key 20*a*, and the ink passing through that space establishes the ink density mainly at the columnar regions 32*a* of the image 34. The ink density at that regions 32*a* is adjustable manually at the ink key itself, and also by means of the switch 36*a*. The switches 36 are marked with numbers on the apparatus, and the respective portions 47*a*, 47*b*, etc. of the CRT display are marked with the same numbers. The beam trace 47 of the CRT display taken as a whole is, therefore, a scale model of both the columnar areas 32*a*, 32*b*, etc. of the printed image and of the contour of the blade 16, with the contour being exaggerated in one direction. If desired, the ink gap space displays 50*a*, 50*b*, etc. can be columns of light.

The display device need not be a cathode ray tube as in the preferred embodiment; other display apparatus can be employed instead. The horizontal scale or size of the display image in relation to the printed sheet can be a 1 to 1 ratio, or smaller or greater than a 1 to 1 ratio.

We claim:

1. An apparatus comprising a printing press having an ink fountain assembly, said ink fountain assembly including a blade with a longitudinally extending edge, an inker roll disposed on one side of said blade closely adjacent to said longitudinally extending edge, an ink key station disposed on a side of said ink fountain blade opposite from said inker roll, and a plurality of adjustable ink keys disposed in a generally horizontal array at said ink key station for varying ink film thickness along said roll, each of said ink keys being associated with a portion of the longitudinally extending edge of said blade and being operable in a first direction to effect movement of the associated portion of the longitudinally extending blade edge in a direction toward said inker roll and away from said ink key station to decrease the thickness of the ink film applied to the inker roll at the associated portion of the edge of said blade and being operable in a second direction to effect movement of the associated portion of the longitudinally extending edge of said blade in a direction away from the inker roll and toward said ink key station to increase the thickness of the ink film applied to the inker roll at the associated portion of the edge of said blade, an inspection table disposed at a location remote from said ink key station and having surface means for supporting stock on which an image was printed by said printing press, said surface means having a plurality of elongated areas each of which is associated with one of said ink keys and a portion of the edge of said blade and is at least partially disposed beneath an associated portion of the image on the stock supported on said table, each of said elongated areas of said surface means being arranged along a transverse axis extending perpendicular to longitudinal axes of said elongated areas in the same order as in which the associated ink keys are arranged in their horizontal array, an operator's station disposed adjacent to first end portions of said elongated areas, display means disposed adjacent to second end portions of said elongated areas opposite from said first end portions of said elongated areas to enable said surface means to support the stock at a location intermediate said operator's station and said display means, said display means including means for displaying a unitary visual image representative of the shape of the space between the longitudinally extending edge of said blade and said inker roll as viewed by an operator at said ink key station and looking downwardly at said ink fountain, said unitary visual image including a horizontal straight line representative of the outer surface of the inker roll and a plurality of line portions disposed in a generally horizontally extending array beneath said straight line, each of said line portions being associated with one of said ink keys and being spaced downwardly from said straight line by a distance which is a function of the distance which the portion of the longitudinally extending edge of said blade associated with said one ink key is spaced apart from the surface of said inker roll, said line portions being arranged in said generally horizontal array in the same order as in which the associated ink keys are arranged in their horizontal array, and control means for effecting operation of said ink keys to vary the spacing between the longitudinally extending edge of said blade and said inker roll and for simultaneously therewith effecting activation of said display means to vary the spacing between said line portions and said straight line, said control means including a plurality of switches disposed at said operator's station in a longitudinal array extending generally parallel to said transverse axis of said elongated areas, each of said switches being associated with one of said ink keys, one of said elongated areas and one of said line portions, said switches being arranged in said longitudinal array in the same order as in which the associated ink keys are arranged in their horizontal array, each of said switches being movable in opposite directions from an initial position, and circuit means connected with each of said ink keys, said switches and said display means for effecting operation of one of said ink keys in the first direction to reduce the spacing between the associated portion of the edge of said blade and said inker roll and for simultaneously therewith effecting upward movement of the associated one of said line portions toward said straight line in response to movement of the associated one of said switches in one direction from its initial position, said circuit means being operable to effect operation of one of said ink keys in the second direction to increase the spacing between the associated portion of the edge of said blade and said inker roll and for simultaneously therewith effecting downward movement of the associated one of said line portions away from said straight line in response to movement of the associated one of said switches from said initial position in a direction opposite from said one direction.

2. An apparatus as set forth in claim 1 wherein said one direction of movement of each of said switches is in a direction away from said operator's station and toward said display means and said other direction of movement of each of said switches is in a direction toward said operator's station and away from said display means.

* * * * *